United States Patent [19]

Rameau

[11] 3,961,614

[45] June 8, 1976

[54] LUBRICATING SYSTEM FOR INTERNAL COMBUSTION ENGINES

[75] Inventor: Jean Rameau, Sannois, France

[73] Assignees: Regie Nationale des Usines Renault; Societe des Automobiles Peugeot, both of Paris, France

[22] Filed: Sept. 25, 1974

[21] Appl. No.: 509,255

[30] Foreign Application Priority Data

Oct. 11, 1973 France ..... 73.36358

[52] U.S. Cl. ..... 123/195 A; 123/196 R; 184/6.28; 184/31

[51] Int. Cl.[2] ..... F02F 7/00

[58] Field of Search ..... 123/195 A, 196 R; 184/1 R, 6.5, 6.28, 31

[56] References Cited

UNITED STATES PATENTS

| | | | |
|---|---|---|---|
| 1,930,533 | 10/1933 | Niven | 123/195 A |
| 2,290,813 | 7/1942 | Ploeger | 184/6.28 |
| 2,470,365 | 5/1949 | O'Daniel | 184/31 |
| 2,572,250 | 10/1951 | Davis | 184/6.28 |
| 2,674,503 | 4/1954 | Martin | 184/31 |
| 3,223,197 | 12/1965 | Conover et al. | 184/6.28 |

*Primary Examiner*—Wendell E. Burns
*Assistant Examiner*—David D. Reynolds
*Attorney, Agent, or Firm*—Oblon, Fisher, Spivak, McClelland & Maier

[57] ABSTRACT

A lubricating system for an internal combustion engine includes a crankcase within which are located the rotating shafts, one of which is the crankshaft, and the bearings for these shafts, the crankcase having disposed above it the cylinder block of the engine, and within its bottom portion the sump for the lubricating oil. The oil pump body is radially centered within a cylinder casing by peripheral engagement with a pump seat, formed within one of the end walls of the cylinder casing of the engine crankcase and the pump body serves as the end bearing for the rotating shaft of the engine, the extension of which constitutes the pump shaft.

7 Claims, 5 Drawing Figures

LUBRICATING SYSTEM FOR INTERNAL COMBUSTION ENGINES

BACKGROUND OF THE INVENTION

1. Field of the Invention

The present invention relates generally to an arrangement for the lubrication of internal combustion engines, the oil pump of which, of the rotary type, is directly coupled to one end of one of the rotary shafts of the engine, and more particularly to an arrangement for the lubrication of an internal combustion engine having a crankcase within which are disposed the rotary engine shafts, one of which is the crankshaft, and the bearings for these shafts, the crankcase having disposed above it the cylinder block of the engine and at its bottom the sump for the lubricating oil. A rotary-type oil pump is provided within the arrangement and is seen to comprise a body within which there is at least one rotor mounted directly upon an extension of one of the rotary shafts of the engine, and a lubrication circuit comprising an intake duct feeding the pump and an output duct supplying the oil passages which lead to the engine bearings.

2. Description of the Prior Art

Arrangements are of course known for lubricating internal combustion engines within which the oil pump is coupled to one end of one of the rotary shafts of the motor, generally the crankshaft, and juxtaposed with one of the end bearings of this shaft, the radial and axial centering of which is thus realized in the usual manner.

Furthermore, within French Pat. Application No. 72/16 134, filed May 5, 1972, which is concerned with the structure of an internal combustion engine which includes cast components including the cylinder block, cylinder head, distribution casing and return casing for the oil, there is disclosed, among other things, the fact that within such structure, the oil passages are formed by casting within the mating surfaces — or gasket surfaces — of the stacked elements, and the apertures for the assembly bolts are connected to the oil passages so as to direct the oil to the points to be lubricated.

SUMMARY OF THE INVENTION

Accordingly, an object of the present invention is to provide an arrangement for the lubrication of internal combustion engines which is intended, by means of its special design, to reduce the cost of manufacturing such engines.

Within an arrangement of the type mentioned above for the lubrication of internal combustion engines, this object is satisfied, in conformity with the present invention, by the fact that the pump body is radially centered as a result of the peripheral engagement of the body within a pump seat formed within one of the end walls, called the pump wall, of the engine crankcase, and by the additional fact that the pump body serves as the end bearing for the rotary shaft of the engine the extension of which constitutes the pump shaft. In this manner of mounting the oil pump wherein one of the engine bearings is replaced and obviated, there is thus permitted the realization of a substantial economy in the overall cost of manufacturing the engine. It is also of importance to formulate the pump seat bore of a large diametrical extent so as to facilitate assembly and/or disassembly or repair of the engine.

Another object of the present invention is to provide the pump body with a cover which is fastened in an oil-tight manner to the pump body and which defines with the latter the space or chamber for the pump rotor, the cover being attached directly to the engine crankcase, and preferably to the outer face of the pump wall of the crankcase, in such a manner as to maintain the pump body pressed or biased against the shoulder of the pump seat. In this manner, the oil pump body cannot rotate nor shift axially as the same is forced against an internal shoulder of the bore, provided within the end wall of the crankcase, by means of the oil pump cover which is itself fastened to the outer face of the wall. As a result of this arrangement, together with the large diameter of the bore within the end wall of the crankcase, it is relatively easy to install and remove the rotary shaft, which may have the oil pump assembly secured upon it, through the bore, the pump cover uniting the pump assembly to the crankcase after the pump body has been fully seated within the bore. In addition, this large opening constituting the bore within the crankcase permits the provision of substantial support being imparted to the mold case during the formation of the interior of the crankcase, the casting process thus being rendered easier to perform and more precise.

Still another object of the present invention is to provide the oil supply passages of the lubrication system of the engine within an intermediate casing such as is described within the French Patent Application No. 72/16 134 cited above, which is interposed between a cylinder casing constituting the cylinder block of the engine and a lower casing constituting the oil sump, and which constitutes the lower supports of the crankshaft bearings, the oil passages being cast along with the bearing supports, this arrangement permitting a substantial reduction in the engine assembly operations.

Yet another object of the present invention is to provide the oil passages of the crankshaft bearings, as well as the supply ducts to which they are directly connected, within one of the gasketed surfaces of the intermediate casing, this technique permitting the avoidance of the use of mold cores.

A further object of the present invention is to dispose the oil pump cover so as to serve to enclose the ends of the intake and output ducts and to provide the cover with cavities upon its inner surface so as to form chambers connecting the supply ducts to the oil pump, such an arrangement again contributing to the substantial reduction of the cost of the engine as a result of the reduction in the number of parts to be machined and assembled, the lubrication system of the invention thus allows a particularly economical realization of an internal combustion engine of conventional design.

BRIEF DESCRIPTION OF THE DRAWINGS

Various other objects, features, and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF A PREFERRED EMBODIMENT

Figure 1:
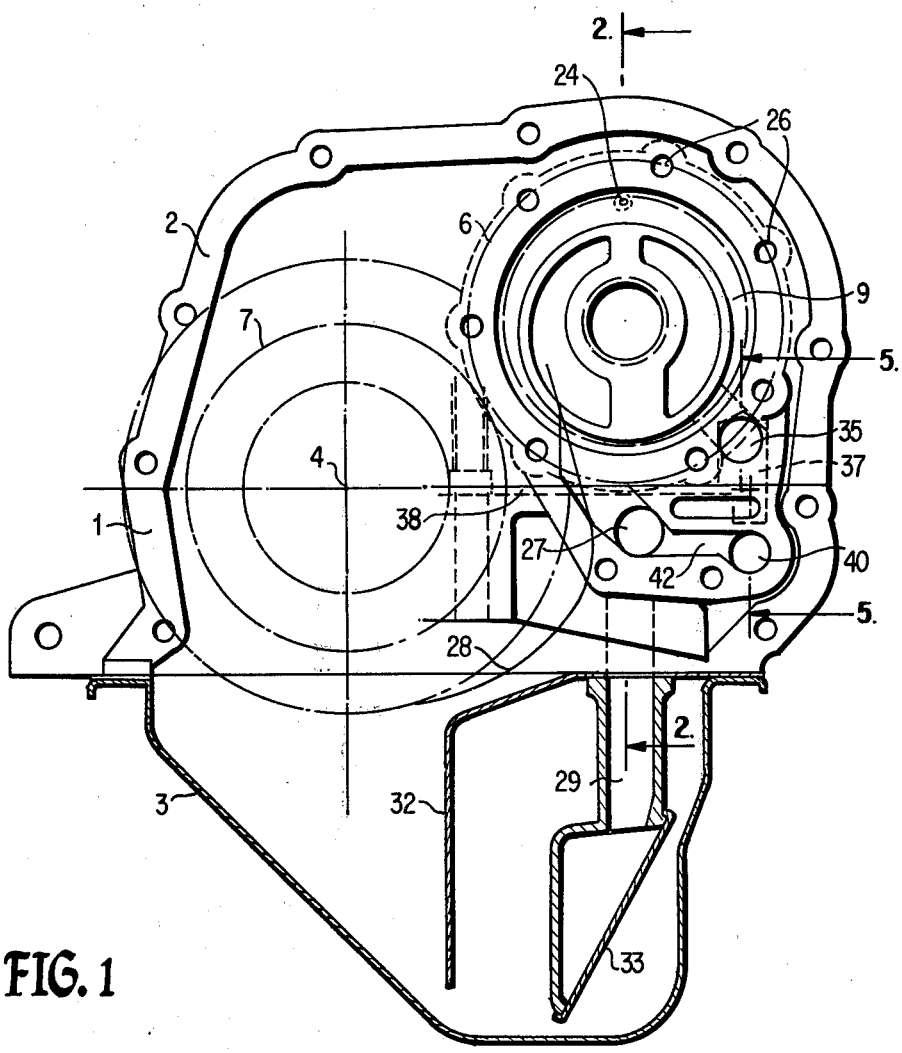
FIG. 1 is a partial, vertical cross-section view through the front portion of the internal combustion engine which is provided with a balancing shaft and a lubrication arrangement constructed in accordance with the present invention, and showing its cooperative parts.
Figure 2:
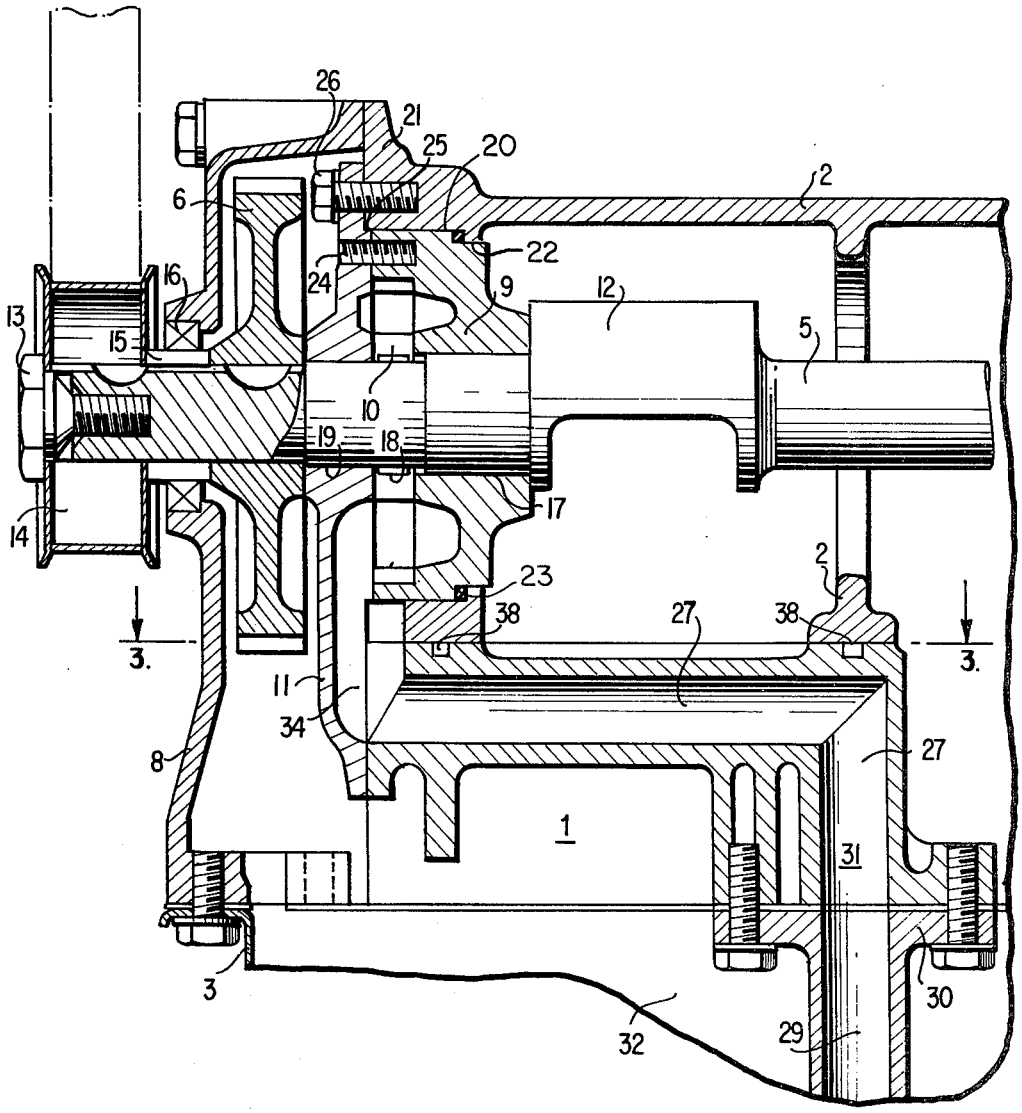
FIG. 2 is a partial, vertical, longitudinal cross-section view of the arrangement of FIG. 1 and taken along the line II—II of FIG. 1.

Referring now to the drawings and more particularly to FIGS. 1 and 2 thereof, it is initially noted that within the drawings, only the middle and lower portions of the engine are shown, the upper portion thereof, such as for example, the cylinders, cylinder head and timing system having been omitted. The general structure of the engine shown by way of an example of a preferred realization of the present invention comprises an intermediate casing 1 which may be a one-piece casting and which is interposed between a cylinder casing 2, which may also be cast in one piece and which forms the cylinder block of the engine, and a lower casing 3 which may be made of stamped sheet metal and which forms the oil pan. The joining and fastening together of these different casings is done in a self-evident manner, such as for example by conventional bolting, and the plane of contact between the upper face of the intermediate casing 1 and the lower face of the cylinder casing 2 is located within a horizontal plane which passes through the longitudinal axis 4 of the crankshaft main bearings, not shown.

The engine has a balancing shaft 5 located within the cylinder casing 2 which is adapted to be driven by means of a gear 6 which is keyed upon one end of shaft 5 and intermeshes with another gear 7 integral with one end of the engine crankshaft, gears 6 and 7 being drawn schematically in chain lines within FIG. 1. A cover 8 is secured to the front face of cylinder casing 2 so as to close off the same and thereby protect the gear train, as well as other mechanical components, from the action of external agents.

The oil pump, which is of the rotary type, is shown within FIG. 2 as having a rotor 10 and a cylindrical body portion 9 and a sealing cover 11 secured thereto, members 9 and 11 defining therebetween the chamber within which the pump rotor 10 is housed. Rotor 10 is disposed upon balancing shaft 5 and is interposed between gear 6 and the front face of a crankpin 12 of shaft 5, the axial position of rotor 10 being adjusted so as to always maintain sufficient space or clearance which is necessary for proper operation thereof. As can be seen from FIG. 2, the rotor assembly is abutted against the front face of crankpin 12 by means of an attachment screw 13 of a pulley unit 14, screw 13 being threadedly engaged within the end of balancing shaft 5, and by the serial axial arrangement of pulley 14, a bushing 15 forming the bearing surface for a seal 16 of cover 8, and gear 6. The pump shaft is thus constituted by a portion of the balancing shaft 5, and in conjunction with such, shaft 5 is successively provided, in the axial direction extending from the front face of crankpin 12 to the forward or left end thereof, with a smooth bearing surface 17 for centering the pump body 9, a splined portion 18 for imparting rotation to rotor 10, and a second bearing surface 19 for centering the pump cover 11.

The pump body 9 is radially centered within the cylinder casing 2 by means of its peripheral engagement with the internal surface of a lower diameter bore 20 which is provided within the front face 21 of cylinder casing 2, and the cover 11 is fastened directly to the front face 21 of cylinder casing 2 by means of fastening screws 26. The pump body 9 is thus rotatably immobilized and is also axially immobilized as a result of being forced against an internal shoulder 22 of casing 2, through means of an interposed O-ring seal 23, by means of pump cover 11 which is rotatably united with pump body 9 by means of a centering pin 24, the axial movement of cover 11 within bore or pump seat 20 being prevented by means of a machined offset portion 25 disposed upon the inner face of cover 11 and which is adapted to engage face 21 of casing 2. The oil pump is thus radially centered within cylinder casing 2 by means of the intermediary of its cylindrical pump body 9 and is united in rotation and axial translation with cylinder casing 2 by means of the intermediary of its cover 11.

It thus follows from the above description that the oil pump forms the front bearing for balancing shaft 5, the rear bearing being of a conventional type, the arrangement thereby permitting the realization of the obviation and saving of one bearing. The front bearing formed by means of the oil pump offers the additional advantage of being self-lubricating as a result of the oil film, formed by capillarity, within the gap necessary for the minimum rotary operating clearances respectively interposed between the bearing surfaces 17 and 19 of balancing shaft 5 and the inner bores of body 9 and cover 11 of the oil pump.

Moreover, the installation and removal of the balancing shaft 5 from the cylindrical casing 2 is rendered relatively easy by means of the configuration adopted, the balancing shaft 5 being capable of being introduced, along with the oil pump assembled to it, through the bore 20 within the front face 21 of cylinder casing 2, cover 11 then being fastened by means of screws 26 upon front face 21 of casing 2 after the pump body 9 has been fully seated within bore 20. Subsequently, gear 6 and bushing 15 may then be coaxially mounted upon shaft 5, and after the assembly of the front cover 8, the pulley 14 may likewise be assembled upon shaft 5, screw 13 thereafter being secured within shaft 5 in order to prevent the ensemble from undergoing any translative movement upon balancing shaft 5. It should be additionally noted that while in accordance with the description of the present invention, the oil pump has been shown as being located upon the balancing shaft 5 of the engine, it is apparent that the pump could alternatively be placed upon any one of the rotary shafts of the engine, such as for example, the crankshaft or camshaft.

Figure 3:
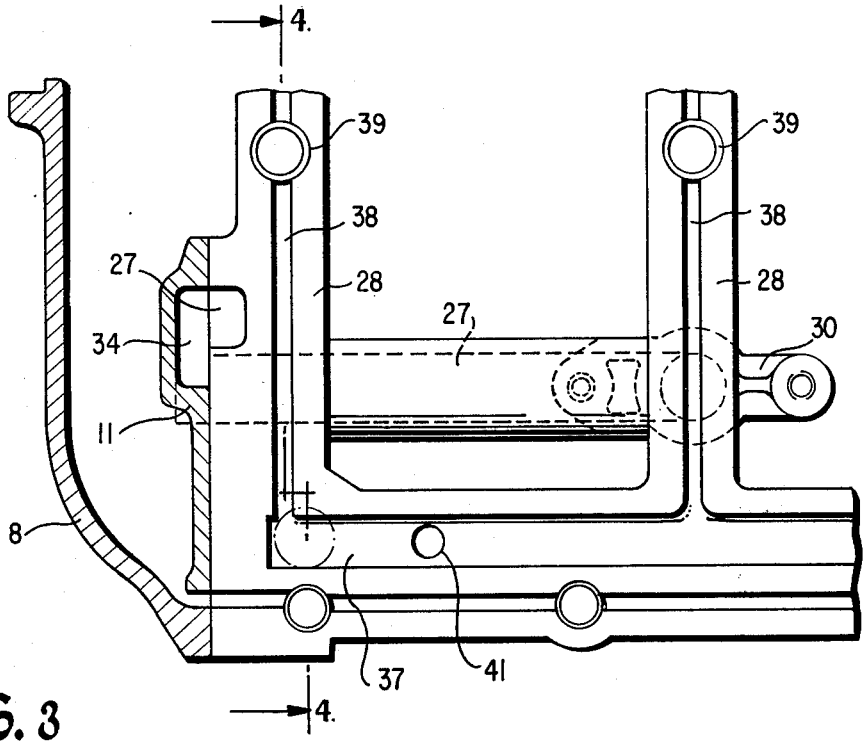
FIG. 3 is a partial, horizontal cross-section view taken along the line III—III of FIG. 2.
Figure 4:
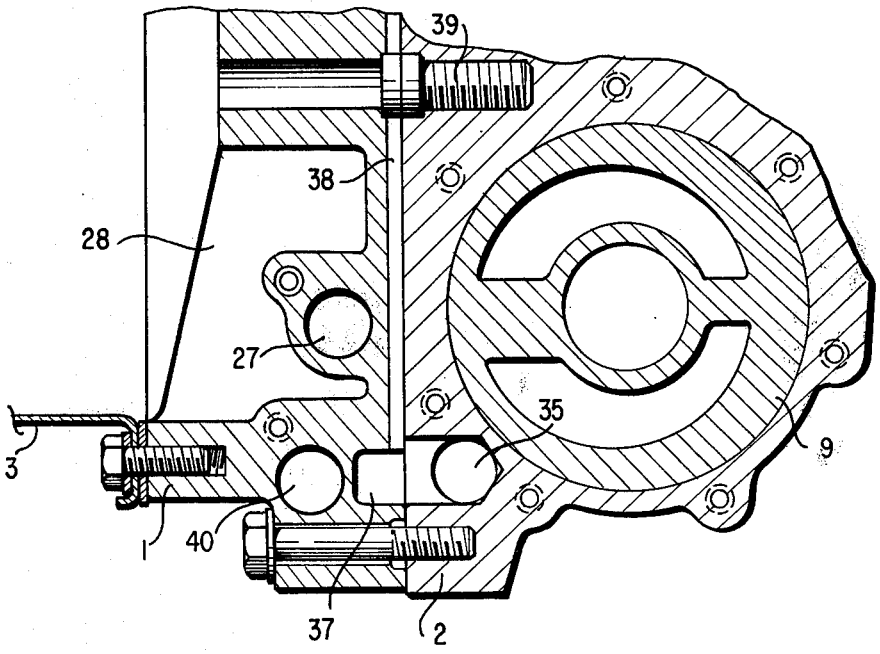
FIG. 4 is a partial, vertical, transverse cross-section view taken along the line IV—IV of FIG. 3.

Referring now additionally to FIGS. 3 and 4, oil is supplied to the pump through means of an intake duct 27 which is integrally formed within intermediate casing 1 and cast in one piece along with the lower supports 28 of the crankshaft bearings. Duct 27 is in turn supplied with oil by means of an intake strainer 29 the dependent end of which extends to the bottom of the lower casing 3 while the upper end 30 is formed with a fastening flange which is adapted to be secured to a similar flange provided upon the bottom face of intermediate casing 1, the flanges being concentric with the inlet orifice 31 of intake duct 27. The joining, by means of bolts, not numbered, of the intake strainer 29 to the bottom face of the intermediate casing 1 also serves to secure a plate 32, which is substantially L-shaped in cross-section. One leg of plate 32 is clamped between flange 30 of the intake strainer 29 and the matching flange of the intermediate casing 1 and is provided at the level of the inlet orifice 31 of intake duct 27; with an aperture of the same diametrical extent as that of orifice 31 so as to allow free passage of the oil feeding the pump, and the other leg thereof is vertically disposed so as to form a transverse partition essentially disposed along the central axis of bottom casing 3 thus separating the casing 3 into two parts. The bottom edge of the partition leg of plate 32 is nevertheless vertically spaced from the bottom surface of the lower casing 3 and this arrangement thus permits a sufficient volume of oil to always be maintained at the intake of filter 33 provided upon the dependent end of the intake strainer 29 so that the oil pump never becomes unprimed no matter what the orientation of the vehicle upon which the engine is mounted.

Figure 5:
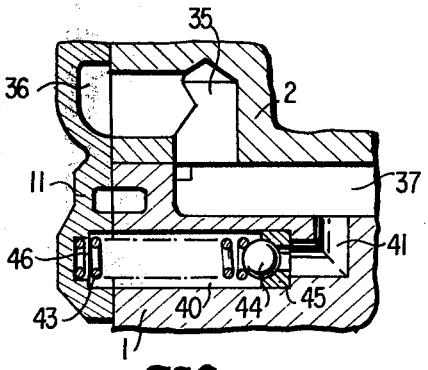
FIG. 5 is a detailed view, in vertical cross-section, taken along the line V—V of FIG. 1.

Reference now being additionally made to FIG. 5, intake duct 27 is connected to the oil pump by means of a vertically disposed cavity 34, as seen in FIG. 2, formed during casting upon the inner surface of the oil pump cover 11. Similarly, the oil pump is connected to the output duct 35 formed within the cylinder casing by means of a second cavity 36 also formed during casting within the inner surface of oil pump cover 11. The oil pump cover 11 thus also serves as the sealing cover of the pump ends of the intake and output ducts, the cavities 34 and 36 forming chambers interconnecting the ducts with the oil pump.

The output duct 35 in turn feeds into a supply duct 37 located within the upper mating surface of intermediate casing 1 and which may thus be formed as a result of direct casting without coring. This supply duct 37 forms the main passage feeding the crankshaft bearing lubrication channels 38 which are also located within the upper mating surface of intermediate casing 1 upon the upper faces of the lower supports 28 of the crankshaft bearings and thus may also be formed as a result of direct casting without coring. As in the cited French Pat. Application No. 72/16 134, the apertures 39, through which pass the assembly pins of the crankshaft half-bearings, are connected with the lubrication channels 38 in order to direct the oil to the points desired to be lubricated.

The pressure-limiting device of the lubrication system of the present invention is also integral with the intermediate casing 1 and comprises a limiter passage 40 which is fluidically fed by a duct 41 which branches off from the head of supply duct 37, and is also provided with a discharge duct 42 which connects the limiter passage 40 to intake duct 27. A spring 43 is disposed within passage 40 so as to bias the limiter valve ball 44 against its seat 45, and the spring is retained at its end opposite the ball 44 by means of a blind bore 46 provided within the inner surface of the oil pump cover 11.

Thus, the arrangement for lubricating internal combustion engines as disclosed by the present invention has important advantages over the known prior art in that such arrangement thus permits, by reason of its design the realization of the saving of one of the bearings of one of the engine shafts and the integration of the lubricating circuit with an intermediate casing within which the circuit is cast with a minimum of coring and machining operations thereby reducing the time and cost of fabrication and assembly of the engine, and therefore achieving a significant decrease in production cost of the entire unit.

Obviously, many modifications and variations of the present invention are possible in light of the above teachings. It is to be understood therefore that within the scope of the appended claims the present invention may be practiced otherwise than as specifically described herein.

What is claimed as new and desired to be secured by Letters Patent of the United States is:

1. An arrangement for the lubrication of an internal combustion engine having a crankcase within which are located the rotary engine shafts, one of which is the crankshaft, and the bearings for said shafts, the cylinder block of said engine being disposed within the upper portion of said crankcase while the oil pan is disposed within the lower portion of said crankcase, said arrangement comprising:

a rotary type oil pump having a body within which is enclosed at least one rotor mounted directly upon an extension of one of said rotary shafts of said engine;

a lubricating circuit including an intake duct fluidically connected to said pump and a supply duct fluidically connected to lubrication channels of said engine bearings;

said pump body being radially centered and removably disposed within said crankcase by means of peripheral engagement with seating means provided within one of the end walls of said engine crankcase and serving as an end bearing for said one of said rotary shafts of said engine; and a cover secured to said oil pump body in an oil-tight manner and which defines, together with said pump body, a space within which said pump rotor is enclosed;

said cover also being directly removably secured to said engine crankcase, and preferably to the front face of said one of the end walls thereof, in such a way as to maintain said pump body pressed against a shoulder of said pump seating means yet permitting said pump body to be removed from said crankcase seating means and said crankcase.

2. An arrangement for the lubrication of an internal combustion engine as set forth in claim 1 wherein:

said oil pump body is further provided with a cover which is secured thereto in an oil-tight manner and which defines, together with said pump body, a space within which said pump rotor is enclosed; and said cover is directly secured to said engine crankcase and preferably to the front face of said one of the end walls thereof, in such a way as to maintain said pump body pressed against a shoulder of said pump seating means.

3. An arrangement for the lubrication of an internal combustion engine as set forth in claim 1, wherein:

said pump seating means of said engine crankcase comprises a bore of circular cross section coaxially disposed with said one of said rotary engine shafts; and means are provided for uniting said cover with said pump body whereby said cover cannot rotate with respect to said body.

4. An arrangement for the lubrication of an internal combustion engine as set forth in claim 3, wherein:

said pump cover and said pump body are respectively secured and retained against said front face of said engine crankcase and against said inner shoulder of said pump bore within said engine crankcase.

5. An arrangement for the lubrication of an internal combustion engine as set forth in claim 1, wherein:

said ducts of said engine lubrication circuit are formed within an intermediate casing of said crankcase which is interposed between a cylinder casing comprising said cylinder block of said engine and a lower casing comprising said oil pan and which contains said supports for said crankshaft half-bearings, said ducts being integrally cast in one piece with said supports.

6. An arrangement for the lubrication of an internal combustion engine as set forth in claim 5, wherein:

said lubrication channels of said crankshaft bearings, as well as said supply ducts with which they are directly fluidically connected, are integrally located within one of the mating surfaces of said intermediate casing when said casing is cast.

7. An arrangement for the lubrication of an internal combustion engine as set forth in claim 1, wherein:

said cover of said oil pump serves as sealing means for the ends of said intake and supply ducts and is provided with cavities within its inner surface so as to form chambers which serve to interconnect said ducts to said oil pump.

* * * * *